US011636803B2

(12) United States Patent
Yao et al.

(10) Patent No.: US 11,636,803 B2
(45) Date of Patent: Apr. 25, 2023

(54) DISPLAY DEVICE AND DRIVING METHOD THEREFOR

(71) Applicant: Kunshan Go-Visionox Opto-Electronics Co., Ltd., Kushan (CN)

(72) Inventors: Yuan Yao, Kunshan (CN); Shuai Ye, Kunshan (CN); Guangyuan Sun, Kunshan (CN); Wenyuan Xi, Kunshan (CN)

(73) Assignee: Kunshan Go-Visionox Opto-Electronics Co., Ltd., Kunshan (CN)

( * ) Notice: Subject to any disclaimer, the term of this patent is extended or adjusted under 35 U.S.C. 154(b) by 0 days.

(21) Appl. No.: 17/684,247

(22) Filed: Mar. 1, 2022

(65) Prior Publication Data

US 2022/0189386 A1 Jun. 16, 2022

Related U.S. Application Data

(63) Continuation of application No. PCT/CN2021/078385, filed on Mar. 1, 2021.

(30) Foreign Application Priority Data

Mar. 3, 2020 (CN) ..... 202010140727.5

(51) Int. Cl.
*G09G 3/32* (2016.01)

(52) U.S. Cl.
CPC ..... *G09G 3/32* (2013.01); *G09G 2300/0408* (2013.01); *G09G 2300/0842* (2013.01);
(Continued)

(58) Field of Classification Search
CPC ..... G09G 3/32; G09G 2300/0408; G09G 2300/0842; G09G 2320/0247;
(Continued)

(56) References Cited

U.S. PATENT DOCUMENTS

2009/0237391 A1 9/2009 Yanagi et al.
2013/0321386 A1* 12/2013 Murai ..... H04N 13/398 345/213

(Continued)

FOREIGN PATENT DOCUMENTS

CN 101496089 A 7/2009
CN 107464517 A 12/2017

(Continued)

OTHER PUBLICATIONS

International Search Report and Written Opinion (International Application No. PCT/CN2021/078385) with English Translation, dated May 21, 2021, 11 pages.

(Continued)

*Primary Examiner* — Andrew Sasinowski
(74) *Attorney, Agent, or Firm* — Adsero IP

(57) ABSTRACT

A display device and a driving method therefor. The display device includes pixel units and pixel scanning circuits, and each of the pixel scanning circuits corresponds to the pixel units of a row. The driving method for the display device includes: driving, by a first driving signal corresponding to a first scanning frequency, the pixel scanning circuits, the first driving signal having row periods corresponding to a frame of image under the first scanning frequency; obtaining a switching signal, and driving, by a second driving signal corresponding to a second scanning frequency, the pixel scanning circuits according to the switching signal. The second driving signal has row periods corresponding to a frame of image under the second scanning frequency, the first scanning frequency is less than the second scanning frequency, and the row period of the first driving signal is greater than the row period of the second driving signal.

17 Claims, 6 Drawing Sheets

(52) U.S. Cl.
CPC ..... *G09G 2320/0247* (2013.01); *G09G 2340/0435* (2013.01)

(58) Field of Classification Search
CPC ..... G09G 2340/0435; G09G 2330/021; G09G 3/20; G09G 2320/02
See application file for complete search history.

(56) References Cited

U.S. PATENT DOCUMENTS

| | | | | |
|---|---|---|---|---|
| 2016/0042692 | A1* | 2/2016 | Ota | G09G 3/3233 345/215 |
| 2017/0092221 | A1* | 3/2017 | Bell | H03M 1/82 |
| 2018/0088424 | A1* | 3/2018 | Park | G09G 3/3607 |
| 2018/0103231 | A1 | 4/2018 | Ahn et al. | |
| 2018/0144681 | A1 | 5/2018 | Xiang et al. | |
| 2019/0122623 | A1* | 4/2019 | Lee | G09G 3/3614 |
| 2021/0035479 | A1* | 2/2021 | Su | G09G 3/3611 |

FOREIGN PATENT DOCUMENTS

| | | | |
|---|---|---|---|
| CN | 107919098 | A | 4/2018 |
| CN | 108109583 | A | 6/2018 |
| CN | 111312145 | A | 6/2020 |
| WO | 2008036689 | A2 | 3/2008 |

OTHER PUBLICATIONS

Chinese First Office Action 100191 (CN Application No. 202010140727.5) and Search Result with English Translation, dated May 31, 2021, 16 pages.

* cited by examiner

DISPLAY DEVICE AND DRIVING METHOD THEREFOR

CROSS-REFERENCE TO RELATED APPLICATIONS

The present application is a continuation application of International Application PCT/CN2021/078385, filed on Mar. 1, 2021, which claims the benefit of Chinese Patent Application No. 202010140727.5, filed on Mar. 3, 2020, entitled "DISPLAY DEVICE AND DRIVING METHOD THEREFOR", the disclosure of both applications is also hereby incorporated by reference in their entireties.

TECHNICAL FIELD

The present application relates to the technology of a display device and driving methods thereof.

BACKGROUND

The display device with high scanning frequency has the advantages of fast response speed and a smooth display of dynamic images.

In related technologies, the display device usually adopts a low scanning frequency when displaying static images and adopts a high scanning frequency when displaying dynamic images.

SUMMARY

It is necessary to provide a display device and a driving method therefor to solve the problem that the traditional display device easily flickers in the process of switching the scanning frequency.

One aspect of the present application provides a driving method for the display device. The display device includes n rows of pixel units and n pixel scanning circuits, and each of the pixel scanning circuits corresponds to the pixel units of a row.

The driving method for the display device includes following steps.

The n pixel scanning circuits are driven by a first driving signal corresponding to a first scanning frequency, the first driving signal has n row periods corresponding to a frame of image under the first scanning frequency.

A switching signal is obtained, and according to the switching signal, the n pixel scanning circuits are driven by a second driving signal corresponding to a second scanning frequency. The second driving signal has n row periods corresponding to a frame of image under the second scanning frequency, the first scanning frequency is less than the second scanning frequency, and the row period of the first driving signal is greater than the row period of the second driving signal.

The n is an integer greater than or equal to 2.

Another aspect of the present application provides a display device including: a display panel, a plurality of data signal driving circuits, n pixel scanning circuits, and a controller. The display panel includes n rows of pixel units, and n rows of pixel driving circuits configured to supply power for the n rows of pixel units. Each of the data signal driving circuits is electrically connected to the pixel driving circuits for the pixel units in a corresponding column. Each of the pixel scanning circuits is electrically connected to the pixel driving circuits for the pixel units in a corresponding row. The controller is electrically connected to the plurality of data signal driving circuits and the n pixel scanning circuits, and configured to control the data signal driving circuits and the pixel scanning circuits and perform the driving method for the display device above.

The driving method for the display device described above includes driving the pixel scanning circuits by means of the first driving signal corresponding to the first scanning frequency, and after the switching signal is obtained, driving the pixel scanning circuits by means of the second driving signal corresponding to the second scanning frequency. Corresponding to a frame of image under the first scanning frequency, the first driving signal has n row periods, and corresponding to a frame of image under the second scanning frequency, the second driving signal has n row periods. The first scanning frequency is smaller than the second scanning frequency, and the row period of the first driving signal is greater than the row period of the second driving signal. Accordingly, when the display device is switched from the lower first scanning frequency to the higher second scanning frequency, since two different driving sequences, namely the first driving signal and the second driving signal, are used, thereby avoiding the abnormal output waveform of the controller, avoiding the phenomenon of the flickering of the display device, and improving the display quality.

DETAILED DESCRIPTION

To make the objectives, features, and advantages of the present application clearer and better understood, the present application will be described in detail with reference to the accompanying drawings. Numerous specific details are set forth in the description below in order to provide a thorough understanding of the present application. However, the present application may be implemented in many other ways other than those described herein. For those skilled in the art, similar improvements can be made without departing from the connotation of the present application, and thus the present application is not limited to the specific embodiments disclosed below. In the process of implementing the related technology, the applicant found that the traditional display device easily flickers in the process of switching from a low scanning frequency to a high scanning frequency. A display device may provide a plurality of scanning frequencies, such as a scanning frequency of 60 Hz and a scanning frequency of 90 Hz. When the display device displays static images such as pictures or text, the low scanning frequency of 60 Hz may be used, so as to save the power consumption of the display device. While the display device displays dynamic images, the high scanning frequency of 90 Hz may be used, so as to improve the degree of the image stream of the display device. Where, the scanning frequency of 60 Hz means that the display device displays 60 frames of images per second, and the scanning frequency of 90 Hz means that the display device displays 90 frames of images per second.

Figure 1:
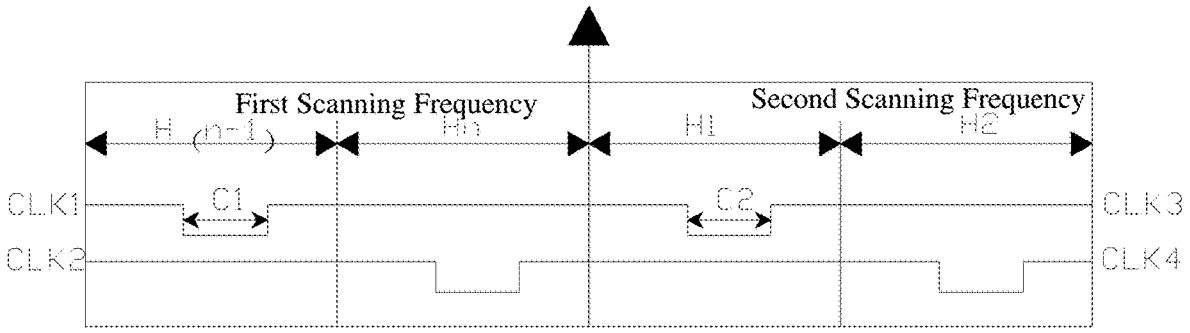
FIG. 1 shows a driving signal sequence diagram of a display device.

FIG. 1 shows a driving signal sequence diagram of a display device. H denotes a row period that is a scanning time for light emitting pixels of each row of each frame of image during the operation of the display device. The time periods of the low-level signals C1 and C2 of the square wave signals of the clock signals CLK1 and CLK2, which correspond to the charging time of the capacitor in the pixel driving circuit, namely, the charging time of the energy storage capacitor in the pixel driving circuit within a row period. The time occupied by one row period includes a charging time and a discharging time of the energy storage capacitor. The voltage difference between the driving signal of discharging and the driving signal of charging is about 7V. As can be seen from FIG. 1, the time allocated for the row period of the display device, operating with the scanning frequency of 60 Hz, is the same as the time allocated for the row period of the display device operating with the scanning frequency of 90 Hz. In addition, the time allocated for charging the capacitor, when the display device operates with the scanning frequency of 60 Hz, is the same as the time allocated for charging the capacitor when the display device operates with the scanning frequency of 90 Hz. Since the scanning time for pixel units of each row of each frame of image corresponding to the scanning frequency of 90 Hz is relatively short, and the row period and the time occupied by charging the capacitor is relatively short, in order to make all row periods in the scanning time of a frame of image to be evenly distributed, a blank time period must be filled between two adjacent row periods corresponding to the scanning frequency of 60 Hz.

In the above implementation process, in the case of the low scanning frequency, there is a relatively long blank time period between two adjacent row periods, which results in poor display effect of the display device operating with the low scanning frequency, and in the process of switching the display device from the low scanning frequency to the high scanning frequency, the phenomenon of flicker may occur.

Figure 2:
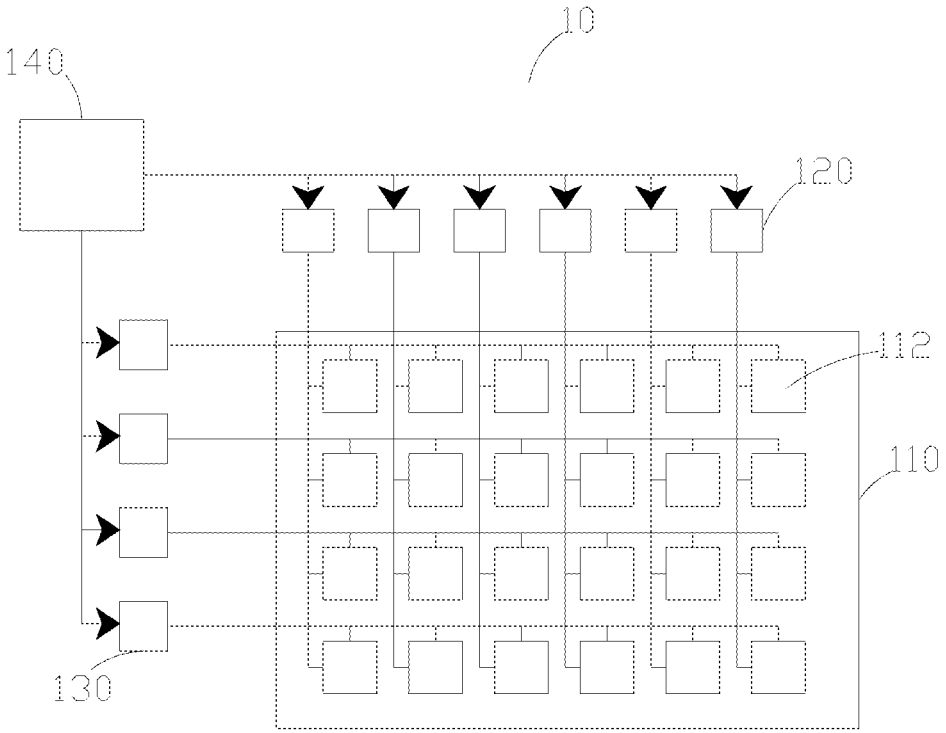
FIG. 2 is a schematic structural view showing a display device of an embodiment of the present application.

In view of the above technical problems, the present application provides a display device 10 and a driving method therefor. As shown in FIG. 2, the display device 10 of the present application includes a display panel 110, a plurality of data signal driving circuits 120, n pixel scanning circuits 130, and a controller 140.

Figure 3:
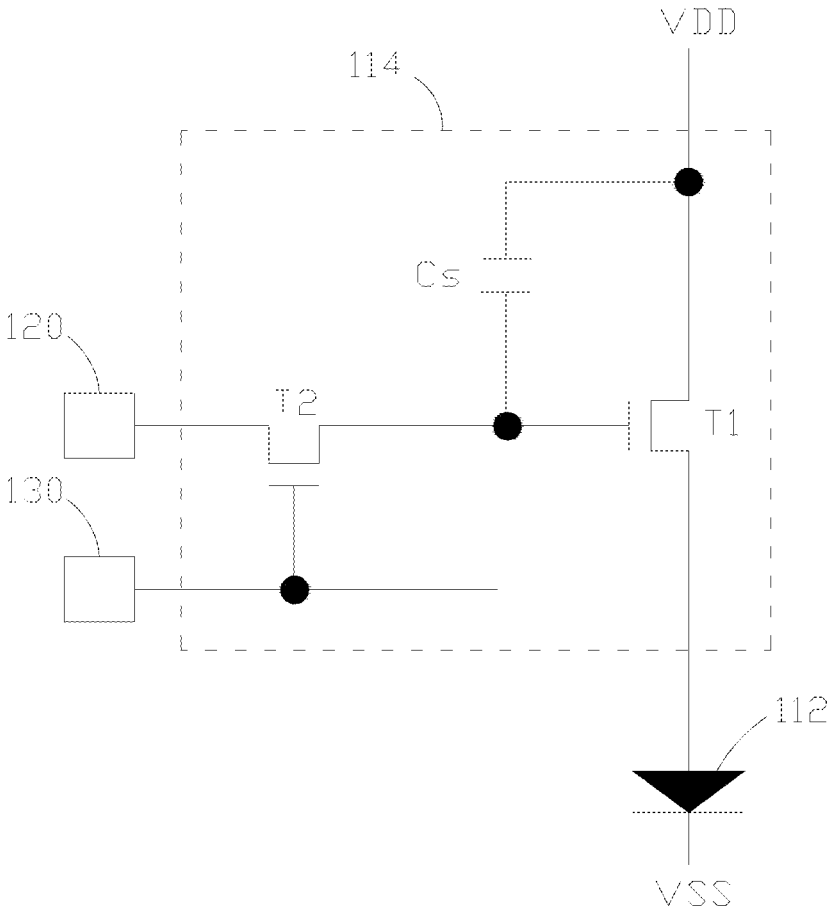
FIG. 3 shows a schematic circuit diagram of the display device of an embodiment of the present application.

Specifically, the display panel 110 is configured to display images. The display panel 110 may include n rows of pixel units 112 and a plurality of pixel driving circuits 114 (not shown in FIG. 2) configured to supply power for the n rows of pixel units 112. Each of the pixel units 112 includes an anode, a cathode, and a light emitting pixel arranged between the anode and the cathode. The pixel driving circuit 114 may include at least two thin-film transistors and at least one capacitor. As shown in FIG. 3, in an embodiment, the pixel driving circuit 114 includes a first thin-film transistor T1, a second thin-film transistor T2, and an energy storage capacitor Cs. Each pixel unit 112 is correspondingly provided with a pixel driving circuit 114 for driving the pixel unit 112. The data signal driving circuit 120 and the pixel scanning circuit 130 are respectively electrically connected to the pixel driving circuit 114.

In an embodiment, as shown in FIG. 3, the grid of the first thin-film transistor T1 is electrically connected to the drain of the second thin-film transistor T2. The energy storage capacitor Cs is connected between the grid and the source of the first thin-film transistor T1. Each data signal driving circuit 120 is electrically connected to the sources of the second thin-film transistors T2 in the pixel driving circuits 114 for the pixel units 112 in a corresponding column. Each pixel scanning circuit 130 is electrically connected to the grids of the second thin-film transistors T2 in the pixel driving circuits 114 for the pixel units 112 in a corresponding row.

Each pixel scanning circuit 130 is electrically connected to the pixel driving circuits 114 of the pixel units in the corresponding row, and is configured to output a level signal to the grids of the switch thin-film transistors namely the second thin-film transistors T2 in the pixel driving circuits 114 of the pixel units in the corresponding row, thus controlling the second thin-film transistors T2 to turn on or to turn off. In the embodiment shown in FIG. 3, the pixel scanning circuit 130 is configured to control the second thin-film transistor T2 to turn on or turn off.

Each data signal driving circuit 120 is electrically connected to the pixel driving circuits 114 for the pixel units 112 in the corresponding column, and is configured to output a level signal to the sources of the switch thin-film transistors namely the second thin-film transistors T2 in the pixel driving circuits 114, thereby providing the pixel driving circuits 114 with digital signal data, so as to charge the energy storage capacitors. In the embodiment shown in FIG. 3, when the pixel scanning circuit 130 controls the second thin-film transistor T2 to turn on, the data signal driving circuit 120 may control and drive the first thin-film transistor T1 to turn on through the second thin-film transistor T2, thereby charging the energy storage capacitor Cs.

The controller 140 is configured to generate a control signal according to the image to be displayed, and control the data signal driving circuit 120 and the pixel scanning circuit 130 by means of the control signal, thereby controlling the pixel driving circuit 114 to turn on or turn off. The controller 140 may be an integrated circuit (IC) chip.

Generally, the display panel 110 includes a plurality of pixel units 112 arranged in an array. Each pixel unit 112 is driven by a pixel driving circuit 114, and each pixel driving circuit 114 is connected to the data signal driving circuit 120 and the pixel scanning circuit 130, respectively. The data signal driving circuit 120 and the pixel scanning circuit 130 jointly control each pixel driving circuit to turn on or turn off. In some embodiments, the display device 10 may have n pixel scanning circuits 130, and the number of the pixel scanning circuits 130 is the same as the number of the rows of the pixel units 112, so that each pixel scanning circuit 130 corresponds to a row of pixel units 112. The letter n denotes the number of the rows of the pixel units 112. The display device 10 has n rows of pixel units 112 and n pixel scanning circuits 130, and each pixel scanning circuit 130 is configured to output a scanning signal to one row of pixel units 112. In this case, when the display panel 110 displays a frame of image, the pixel driving circuits 114 on the display panel 110 is turned on row by row, that is, all the pixel units 112 emit light row by row. In a frame of image, the scanning time for pixel units of each row is called the row period.

In an embodiment, the controller 140 may control the pixel scanning circuits by executing the driving method for the display device described below, thereby improving the display quality of the display device 10.

Figure 4:
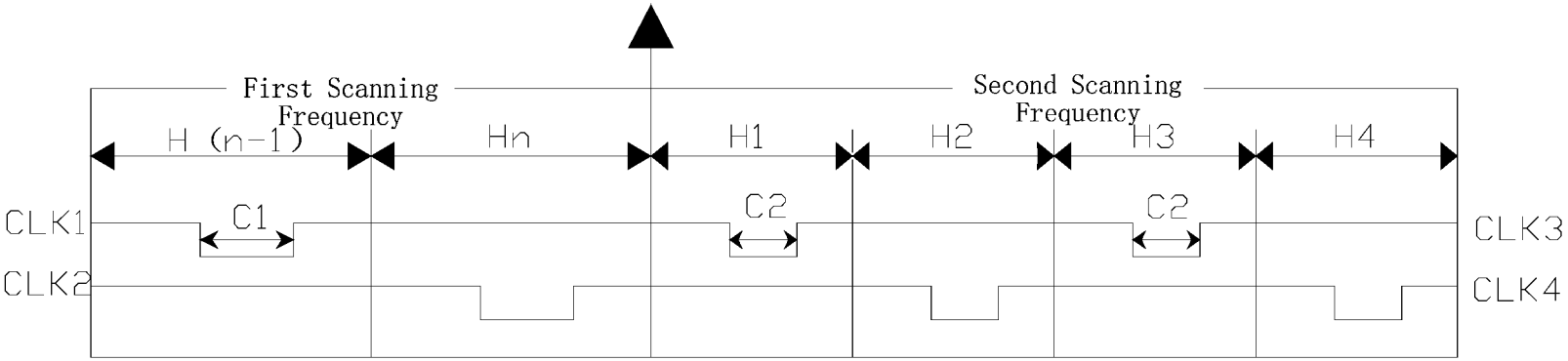
FIG. 4 shows a driving signal sequence diagram of the display device according to an embodiment of the present application.

In an embodiment, the driving signal sequence diagram of the driving method for the display device of the present application is shown in FIG. 4, and the driving method for the display device includes following steps.

In step S100, n pixel scanning circuits 130 are driven by a first driving signal corresponding to a first scanning frequency, where the first driving signal has n row periods corresponding to a frame of image under the first scanning frequency.

The controller 140 drives the pixel scanning circuits 130 one by one by means of the first driving signal, thereby driving the pixel driving circuits 114 row by row. The first driving signal means that when the controller 140 drives the pixel scanning circuits 130 by means of the first driving signal, the scanning frequency of the display panel 110 is the first scanning frequency. In other words, when the display device 10 adopts the first driving signal to drive the pixel scanning circuits 130, the display panel 110 is scanned with the first scanning frequency.

The row period of the first driving signal refers to the scanning time for a row of pixel units 112 of each frame of image under the first scanning frequency. Generally, when the display panel 110 displays a frame of image, the pixel units 112 on the display panel 110 are turned on row by row, that is, all the pixel units emit light row by row. In the present application, n denotes the number of rows of the pixel units 112 on the display panel 110. In step S100, the first driving signal has n row periods corresponding to a frame of image under the first scanning frequency. The n can be an integer greater than or equal to 2, that is, the display device 10 includes at least two rows of pixel units 112 and at least two pixel scanning circuits 130, and each pixel scanning circuit 130 corresponds to each row of pixel units 112 one to one.

Generally, the controller 140 may obtain the first scanning frequency according to the type of the image to be displayed, and may also obtain the first scanning frequency according to other devices embedded in the display device 10, which is not limited herein. When the display device 10 needs to display the image with the first scanning frequency, the controller 140 drives the pixel scanning circuits through the first driving signal, thereby completing the scanning for the pixel driving circuits 114.

In step S200, a switching signal is obtained, and according to the switching signal, the n pixel scanning circuits are driven by a second driving signal corresponding to the second scanning frequency. The second driving signal has n row periods corresponding to a frame of image under the second scanning frequency. The first scanning frequency is less than the second scanning frequency, and the row period of the first driving signal is greater than the row period of the second driving signal.

The controller 140 obtains the switching signal. The switching signal herein refers to the switching signal for the scanning frequency when the display device 10 displays the image. The controller 140 may obtain the switching signal according to the switching of the types of the images to be displayed, and may also obtain the switching signal according to other devices embedded in the display device 10, which is not limited here. After the controller 140 obtains the switching signal, the controller 140 drives the pixel scanning circuits 130 one by one by means of the second driving signal. The second driving signal herein means that when the controller 140 drives the pixel scanning circuits 130 by means of the second driving signal, the scanning frequency of the display panel 110 is the second scanning frequency. In other words, when driven by the second driving signal, the display panel 110 is scanned with the second scanning frequency.

The row period of the second driving signal refers to the scanning time for one row of light emitting pixels of each frame of image under the second scanning frequency. Therefore, when the display panel 110 has n rows of light emitting pixels, the second driving signal has n row periods corresponding to a frame of image under the second scanning frequency. Herein, n is greater than or equal to 2, which will not be described repeatedly hereafter.

In an embodiment, the first scanning frequency is less than the second scanning frequency, and the row period of the first driving signal is greater than the row period of the second driving signal. For example, the first scanning frequency may be 60 Hz, that is, under the first scanning frequency, the display panel 110 displays 60 frames of images per second. At this time, assuming that the display panel 110 has n rows of light emitting pixels, the time occupied by the row period of the first driving signal should be equal to or less than $\frac{1}{60n}$ second. The second scanning frequency may be 90 Hz, that is, under the second scanning frequency, the display panel 110 displays 90 frames of images per second. At this time, the time occupied by the row period of the second driving signal may be $\frac{1}{90n}$ second. The row period of the first driving signal is equal to or less than $\frac{1}{60n}$ second and greater than $\frac{1}{90n}$ second.

In this embodiment, the first scanning frequency is less than the second scanning frequency and the row period of the first driving signal is greater than the row period of the second driving signal. Therefore, when the display device is scanned with the first scanning frequency, compared with related technologies, the blank time between two adjacent row periods of the first driving signal is shortened, thereby improving the display effect of the display device 10 under the low scanning frequency. Furthermore, it is tested by the inventors that when the scanning frequency is switched from a lower first scanning frequency to a higher second scanning frequency, and because there are two different driving sequences being used, namely the first driving signal and the second driving signal, an abnormal output waveform of the controller 140 may be avoided, thereby preventing the display device 10 from flickering and improving the display quality.

The inventive idea of the driving method for the display device of the present application is that two different driving sequences are used for different cases of the first scanning frequency and the second scanning frequency, so as to prevent the display device 10 from flickering while the scanning frequency is being switched. Therefore, the embodiments described above only limit the switching from the first scanning frequency to the second scanning frequency, but those skilled in the art may also unambiguously know that when the scanning frequency is switched from the second scanning frequency to the first scanning frequency, two different types of driving sequences may be used, so as to prevent the display device 10 from flickering, and such technical solutions should also be understood to be within the protection scope of the present application.

Further, the time occupied by a single row period of the first driving signal is a reciprocal product of the first scanning frequency and the number of row periods of the first driving signal of a frame of image, that is, the reciprocal product of the first scanning frequency and the number n of rows of the light emitting pixels. For example, if the first scanning frequency is 60 Hz, and the display panel 110 has n rows of light emitting pixels, then the time occupied by a single row period of the first driving signal is $\frac{1}{60n}$ second. The time occupied by a single row period of the second driving signal is a reciprocal product of the second scanning frequency and the number of row periods of the second driving signal of a frame of image, that is, the reciprocal product of the second scanning frequency and the number n of rows of the light emitting pixels. For example, if the second scanning frequency is 90 Hz, and the display panel 110 has n rows of light emitting pixels, then the time occupied by a single row period of the second driving signal is 1/90n second. In this case, when the step S100 is performed, that is, when the pixel scanning circuits 114 are driven by the first driving signal corresponding to the first scanning frequency, there is no blank time between two adjacent row periods, thereby improving the display effect of the display device 10 under the low scanning frequency, avoiding the abnormal output waveform of the controller 140, preventing the display device 10 from flickering, and improving the display quality.

In another embodiment of the present application, each row period of the first driving signal includes the first charging time for charging the energy storage capacitor, and each row period of the second driving signal includes the second charging time for charging the energy storage capacitor. The first charging time is greater than the second charging time, so that each of the pixel units of each row has a relatively long charging time under the low scanning frequency of the display device, and the blank time filled between two adjacent row periods is reduced, thereby improving the display effect of the display device under the low scanning frequency.

In another embodiment of the present application, the first charging time corresponding to the pixel units in the ith row is within the ith row period of the first driving signal, and the second charging time corresponding to the pixel units in the ith row is within the ith row period of the second driving signal, where i is greater than or equal to 1, and less than or equal to n.

Specifically, when the controller 140 drives the pixel scanning circuits 130 with the first driving signal, it needs to start scanning from the pixel units in the first row of a frame of image. At this time, the pixel units in the first row correspond to the first row period of the first driving signal, and the first charging time corresponding to the pixel units in the first row is within the first row period of the first driving signal. Likewise, when the controller 140 drives the pixel scanning circuits 130 with the second driving signal, the second charging time corresponding to the pixel units in each row is within the corresponding row period of the second driving signal that drives the pixel units in the row.

In another embodiment of the present application, each first charging time has the same start time point and the same end time point within the corresponding row period of the first driving signal, and each second charging time has the same start time point and the same end time point within the corresponding row period of the second driving signal. As shown in FIG. 4, taking two row periods corresponding to the first driving signal and the second driving signal as an example, the start time point and the end time point of the first charging time within the nth row period of the first driving signal are the same as the start time point and the end time point of the first charging time within the (n−1)th row period of the first driving signal, respectively, and the start time point and the end time point of the second charging time within the first row period of the second driving signal are the same as the start time point and the end time point of the second charging time within the second row period of the second driving signal, respectively, so that when a frame of image is displayed with the same scanning frequency, the display effect of the pixel units of each row tends to be consistent, thereby effectively reducing the problem of a mura of the display, thereby improving the overall display effect of the display panel 110.

Figure 5:
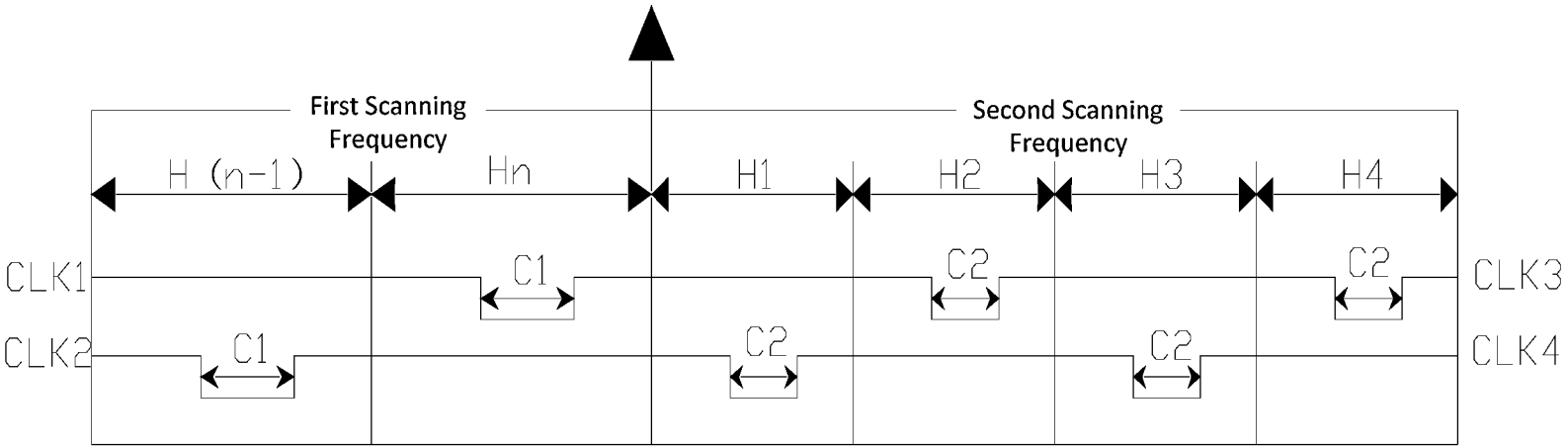
FIG. 5 shows a driving signal sequence diagram of the display device according to another embodiment of the present application.
Figure 6:
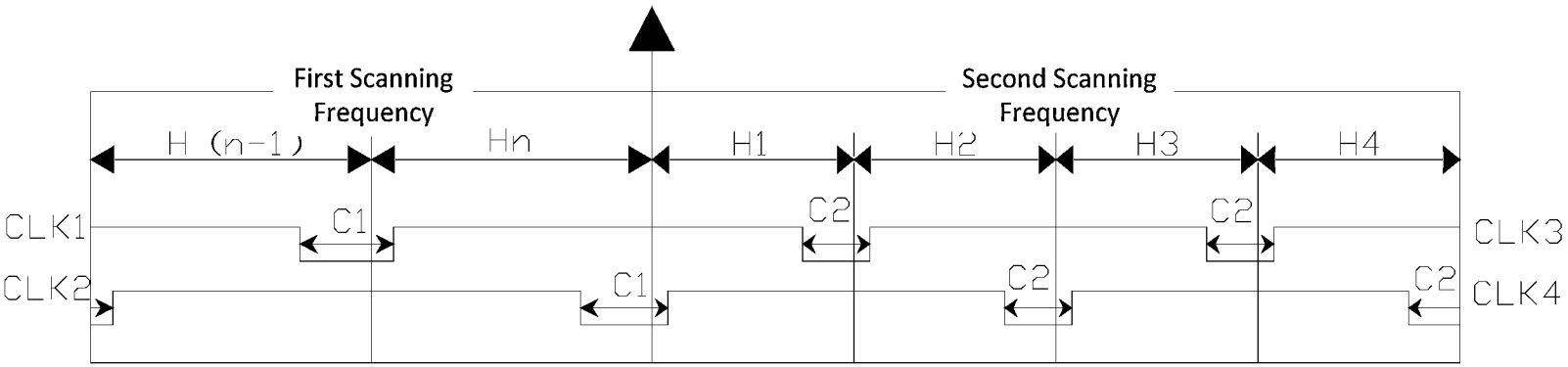
FIG. 6 shows a driving signal sequence diagram of the display device according to yet another embodiment of the present application.

Further, as shown in FIG. 4 to FIG. 6, the first driving signal includes two clock signals, which are the first clock signal CLK1 and the second clock signal CLK2, respectively. The first clock signal CLK1 of the first driving signal and the second clock signal CLK2 of the first driving signal include n first effective level signals C1 corresponding to n first charging time. Similarly, after the scanning frequency is switched, the second driving signal still includes two clock signals, namely the third clock signal CLK3 and the fourth clock signal CLK4, and the third clock signal CLK3 and the fourth clock signal CLK4 include n second effective level signals C2 corresponding to n second charging time. As shown in FIG. 4, the first effective level signal C1, which corresponds to the first charging time in the (n−1)th row period of the first driving signal, is within the first clock signal CLK1 of the first driving signal, which corresponds to the (n−1)th row period H(n−1) of the first driving signal. The first effective level signal C1, which corresponds to the first charging time in the nth row period of the first driving signal, is within the second clock signal CLK2 of the first driving signal, which corresponds to the nth row period H(n) of the first driving signal. The second effective level signal C2, which corresponds to the second charging time in the first row period of the second driving signal, is within the third clock signal CLK3 of the second driving signal, which corresponds to the first row period H(1) of the second driving signal. The second effective level signal C2, which corresponds to the second charging time in the second row period of the second driving signal, is within the fourth clock signal CLK4 of the second driving signal, which corresponds to the second row period H(2) of the second driving signal.

In another embodiment of the present application, as shown in FIG. 5, the first effective level signal C1, which corresponds to the first charging time in the (n−1)th row period of the first driving signal, is within the second clock signal CLK2 of the first driving signal, which corresponds to the (n−1)th row period H(n−1) of the first driving signal. The first effective level signal C1, which corresponds to the first charging time in the nth row period of the first driving signal, is within the first clock signal CLK1 of the first driving signal, which corresponds to the nth row period H(n) of the first driving signal. The second effective level signal C2, which corresponds to the second charging time in the first row period of the second driving signal, is within the fourth clock signal CLK4 of the second driving signal, which corresponds to the first row period H(1) of the second driving signal. The second effective level signal C2, which corresponds to the second charging time in the second row period of the second driving signal, is within the third clock signal CLK3 of the second driving signal, which corresponds to the second row period H(2) of the second driving signal.

In another embodiment of the present application, as shown in FIG. 6, each of the first effective level signals C1 includes a first falling edge and a first rising edge. The first falling edge of the first effective level signal C1 in the ith row period of the first driving signal is within the first charging time in the ith row period of the first driving signal, and a start time point of the first falling edge of the first effective level signal C1 in the ith row period of the first driving signal is the same as a start time point of the first charging time in the ith row period of the first driving signal. The first rising edge of the first effective level signal C1 in the ith row period of the first driving signal is within a first non-charging time in the (i+1)th row period of the first driving signal. When i is equal to n, the first rising edge of the first effective level signal C1 in the ith row period of the first driving signal is within a first non-charging time in the first row period of the first driving signal of a next frame of image. Each second effective level signal C2 includes a second falling edge and a second rising edge. The second falling edge of the second effective level signal C2 in the ith row period of the second driving signal is within the second charging time in the ith row period of the second driving signal, and a start time point of the second falling edge of the second effective level signal C2 in the ith row period of the second driving signal is the same as a start time point of the second charging time in the ith row period of the second driving signal. The second rising edge of the second effective level signal C2 in the ith row period of the second driving signal is within a second non-charging time in the (i+1)th row period of the second driving signal. When i is equal to n, the second rising edge of the second effective level signal C2 in the ith row period of the second driving signal is within the second non-charging time in the first row period of the second driving signal of a next frame of image. When the display device 10 is driven to display according to the first driving signal and the second driving signal shown in FIG. 6, not only the display effect under the low scanning frequency can be ensured, but also the abnormal waveform of the signal can be avoided when the first scanning frequency is switched to the second scanning frequency. An abnormal waveform of the signal may cause the pixel scanning circuit to work abnormally and further cause the phenomenon of flickering of screen.

It should be noted that, while driving the pixel scanning circuit 130, the first clock signal CLK1 and the third clock signal CLK3 are the clock signals corresponding to different scanning frequencies of the display device 10, and are output through the same signal line at different display time. Similarly, the second clock signal CLK2 and the fourth clock signal CLK4 are also output through the same signal line at different display time.

Furthermore, the time periods that the first rising edges of all first effective level signals in the first driving signal last for are identical, and the time periods that the first falling edges of all first effective level signals in the first driving signal last for are identical. The time periods that the second rising edges of all second effective level signals in the second driving signal last for are identical, and the time periods that the second falling edges of all second effective level signals in the second driving signal last for are identical. In this case, the phenomenon of the flickering of screen may be avoided while the scanning frequency of the display device 10 is being switched. All row periods of the first driving signal have the same first charging time, and all row periods of the second driving signal have the same second charging time, thereby improving the display effect of the display device 10.

In one of the embodiments, the time period that the first effective level signal lasts for is greater than the time period that the second effective level signal lasts for.

In one of the embodiments, the length of time, in which the first effective level signal in the ith row period of the first driving signal continues to be within the corresponding first charging time, is greater than the length of time, in which the second effective level signal in the ith row period of the second driving signal continues to be within the corresponding second charging time. The length of time, in which the first effective level signal in the ith row period of the first driving signal continues to be within the corresponding first charging time, is greater than the length of time, in which the first effective level signal in the (i+1)th row period of the first driving signal continues to be within the corresponding first charging time. The length of time, in which the second effective level signal in the ith row period of the second driving signal continues to be within the corresponding second charging time, is greater than the length of time, in which the second effective level signal in the (i+1)th row period of the second driving signal continues to be within the corresponding second charging time.

In an embodiment, the first scanning frequency may be one of 60 Hz, 30 Hz, 10 Hz, 5 Hz, 4 Hz, 2 Hz, and 1 Hz, and the second scanning frequency may be one of 90 Hz, 120 Hz, and 240 Hz. It should be understood that one of the technical problems to be solved by the present application is caused when the display device 10 is switched from the low scanning frequency to the high scanning frequency. Therefore, provided that the values of the first scanning frequency and the second scanning frequency satisfy that the first scanning frequency is less than the second scanning frequency, they should be understood to be within the protection scope of the present application.

The driving method for the display device of the present application includes driving the pixel scanning circuits 130 by means of the first driving signal corresponding to the first scanning frequency, and after the switching signal is obtained, driving the pixel scanning circuits 130 by means of the second driving signal corresponding to the second scanning frequency. Corresponding to a frame of image under the first scanning frequency, the first driving signal has n row periods, and corresponding to a frame of image under the second scanning frequency, the second driving signal has n row periods. The first scanning frequency is smaller than the second scanning frequency, and the row period of the first driving signal is greater than the row period of the second driving signal. In this case, when the display device is switched from the lower first scanning frequency to the higher second scanning frequency, since two different driving sequences, namely the first driving signal and the second driving signal, are used for the first scanning frequency and the second scanning frequency, respectively, thereby avoiding the abnormal output waveform of the controller 140, avoiding the phenomenon of the flickering of the display device 10, and improving the display quality. Moreover, the row period of the first driving signal is greater than the row period of the second driving signal, which may avoid affecting the display effect due to too long blank time between the row periods under the low scanning frequency, thereby improving the display quality under the low scanning frequency.

In an embodiment, a display device 10 includes a display panel 110, a plurality of data signal driving circuits 120, n pixel scanning circuits 130, and a controller. The display panel 110 includes n rows of pixel units 112, and n rows of pixel driving circuit 114 configured to supply power for the n rows of pixel units 112. Each of the data signal driving circuits 120 is electrically connected to the pixel driving circuits 114 for the pixel units 112 in a corresponding column. Each of the pixel scanning circuits 130 is electrically connected to the pixel driving circuits 114 for the pixel units 112 in a corresponding row. The controller 140 is electrically connected to the plurality of data signal driving circuits 120 and the n pixel scanning circuits 130, and configured to control the data signal driving circuits 120 and the pixel scanning circuits 130. The display device 10 is driven by the driving method for the display device described above.

The embodiments described above are only several implementations of the present application, and these embodiments are specific and detailed, but not intended to limit the scope of the present application. It should be understood by those skilled in the art that various modifications and improvements may be made without departing from the conception of the present application, and all fall within the protection scope of the present application. Therefore, the patent protection scope of the present application is defined by the appended claims.

What is claimed is:

1. A driving method for a display device, the display device comprising n rows of pixel units and n pixel scanning circuits, and each of the pixel scanning circuits corresponding to the pixel units of a row, the driving method for the display device comprising: driving, by a first driving signal corresponding to a first scanning frequency, the n pixel scanning circuits, first driving signal has n row periods corresponding to a frame of image under the first scanning frequency; and obtaining a switching signal, and driving, by a second driving signal corresponding to a second scanning frequency, the n pixel scanning circuits according to the switching signal, wherein the second driving signal has n row periods corresponding to a frame of image under the second scanning frequency, the first scanning frequency is less than the second scanning frequency, and the row period of the first driving signal is greater than the row period of the second driving signal;

wherein, n is an integer greater than or equal to 2.

2. The driving method for the display device according to claim 1, wherein:

each of row periods of the first driving signal comprises a first charging time;

each of row periods of the second driving signal comprises a second charging time; and the first charging time is greater than the second charging time.

3. The driving method for the display device according to claim 2, wherein: the first charging time corresponding to the pixel units in an ith row is within an ith row period of the first driving signal;

the second charging time corresponding to the pixel units in the ith row is within an ith row period of the second driving signal; and i is greater than or equal to 1, and less than or equal to n.

4. The driving method for the display device according to claim 3, wherein: each first charging time has a same start time point and a same end time point within each of the row periods of the first driving signal; and each second charging time has a same start time point and a same end time point within each of the row periods of the second driving signal.

5. The driving method for the display device according to claim 2, wherein: the first driving signal includes two clock signals;

the two clock signals of the first driving signal comprise n first effective level signals corresponding to n first charging time;

each of the first effective level signals comprises a first falling edge and a first rising edge;

the first falling edge of each of the first effective level signals in an ith row period of the first driving signal is within the first charging time in the ith row period of the first driving signal, and a start time point of the first falling edge of each of the first effective level signal in the ith row period of the first driving signal is the same as a start time point of the first charging time in the ith row period of the first driving signal;

the first rising edge of each of the first effective level signals in the ith row period of the first driving signal is within a first non-charging time in an (i+1)th row period of the first driving signal;

the second driving signal includes two clock signals;

the two clock signals of the second driving signal comprise n second effective level signals corresponding to n second charging time;

each of the second effective level signals comprises a second falling edge and a second rising edge;

the second falling edge of each of the second effective level signals in the ith row period of the second driving signal is within the second charging time in the ith row period of the second driving signal, and a start time point of the second falling edge of each of the second effective level signals in the ith row period of the second driving signal is the same as a start time point of the second charging time in the ith row period of the second driving signal; and the second rising edge of each of the second effective level signals in the ith row period of the second driving signal is within a second non-charging time in an (i+1)th row period of the second driving signal.

6. The driving method for the display device according to claim 5, wherein: time periods, which first rising edges of all the first effective level signals in the first driving signal last for are identical;

time periods, which first falling edges of all the first effective level signals in the first driving signal last for, are identical;

time periods, which second rising edges of all the second effective level signals in the second driving signal last for, are identical; and time periods, which second falling edges of all second effective level signals in the second driving signal last for, are identical.

7. The driving method for the display device according to claim 5, wherein a time period, which each of the first effective level signals lasts for, is greater than a time period, which each of the second effective level signals lasts for.

8. The driving method for the display device according to claim 7, wherein: a length of time, in which each of the first effective level signal in the ith row period of the first driving signal continues to be within a corresponding first charging time thereof, is greater than a length of time, in which each of the second effective level signals in the ith row period of the second driving signal continues to be within a corresponding second charging time thereof;

a length of time, in which each of the first effective level signals in the ith row period of the first driving signal continues to be within the corresponding first charging time, is greater than a length of time, in which each of the first effective level signals in the (i+1)th row period of the first driving signal continues to be within a corresponding first charging time; and a length of time, in which each of the second effective level signals in the ith row period of the second driving signal continues to be within a corresponding second charging time thereof, is greater than a length of time, in which each of the second effective level signals in the (i+1)th row period of the second driving signal continues to be within a corresponding second charging time thereof.

9. The driving method for the display device according to claim 1, wherein the first scanning frequency is one of 60 Hz, 30 Hz, 10 Hz, 5 Hz, 4 Hz, 2 Hz, and 1 Hz; and wherein the second scanning frequency is one of 90 Hz, 120 Hz, and 240 Hz.

10. The driving method for the display device according to claim 1, wherein the row period is scanning time for the pixel units of each row.

11. A display device, comprising:

a display panel, comprising n rows of pixel units and n rows of pixel driving circuits configured to supply power for the n rows of pixel units;

a plurality of data signal driving circuits, each of the data signal driving circuits electrically connected to the pixel driving circuits for the pixel units in a corresponding column;

n pixel scanning circuits, each of the pixel scanning circuits electrically connected to the pixel driving circuits for the pixel units in a corresponding row; and a controller electrically connected to the data signal driving circuits and the n pixel scanning circuits, wherein the controller is configured to control the data signal driving circuits and the pixel scanning circuits and perform the driving method for the display device of claim 1.

12. The display device according to claim 11, wherein each of the pixel units comprises an anode, a cathode, and a light emitting pixel arranged between the anode and the cathode.

13. The display device according to claim 11, wherein: each of the pixel driving circuits comprises a first thin-film transistor, a second thin-film transistor, and an energy storage capacitor;

a grid of the first thin-film transistor is electrically connected to a drain of the second thin-film transistor;

an energy storage capacitor is connected between the grid and a source of the first thin-film transistor;

each of the data signal driving circuits is electrically connected to a source of the second thin-film transistors in each of the pixel driving circuits for the pixel units in the corresponding column; and each of the pixel scanning circuits is electrically connected to a grid of the second thin-film transistors in each of the pixel driving circuits for the pixel units of the corresponding row.

14. The display device according to claim 13, wherein each of the pixel scanning circuits is configured to control the second thin-film transistor in each of the pixel driving circuits for the pixel units of the corresponding row.

15. The display device according to claim 11, wherein the controller is an integrated circuit chip.

16. The display device according to claim 11, wherein the controller is configured to obtain a first scanning frequency according to a type of an image to be displayed.

17. The display device according to claim 11, wherein the controller is configured to obtain a switching signal according to a type of an image to be displayed, and the switching signal is provided for a scanning frequency when the display device displays an image.

* * * * *